US007664440B2

(12) United States Patent
Maezawa et al.

(10) Patent No.: US 7,664,440 B2
(45) Date of Patent: Feb. 16, 2010

(54) DEVELOPING DEVICE AND IMAGE FORMING APPARATUS HAVING THE SAME

(75) Inventors: Nobuhiro Maezawa, Yamatokoriyama (JP); Toshimasa Hamada, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/130,275

(22) Filed: May 30, 2008

(65) Prior Publication Data

US 2008/0298850 A1 Dec. 4, 2008

(30) Foreign Application Priority Data

May 31, 2007 (JP) ..... P2007-145887

(51) Int. Cl.
*G03G 15/09* (2006.01)

(52) U.S. Cl. ..... 399/277; 399/267; 399/274; 399/276; 399/282

(58) Field of Classification Search ..... 399/267, 399/272, 274–277, 281–282, 284
See application file for complete search history.

(56) References Cited

U.S. PATENT DOCUMENTS 4,814,820 A * 3/1989 Hirahara et al. ..... 399/256
5,129,357 A * 7/1992 Yamaji ..... 399/277
2004/0234299 A1 11/2004 Koetsuka et al.

FOREIGN PATENT DOCUMENTS

| | | |
|---|---|---|
| JP | 2-144585 A | 6/1990 |
| JP | 8-146757 | 6/1996 |
| JP | 2000-148940 A | 5/2002 |
| JP | 2002-148940 A | 5/2002 |
| JP | 2002-148942 | 5/2002 |
| JP | 2002-182475 | 6/2002 |
| JP | 2003-323051 | 11/2003 |
| JP | 2004-271876 A | 9/2004 |

* cited by examiner

*Primary Examiner*—David M Gray
*Assistant Examiner*—Barnabas T Fekete
(74) *Attorney, Agent, or Firm*—Nixon & Vanderhye, P.C.

(57) ABSTRACT

A developing device and an image forming apparatus capable of restraining density irregularity and restraining a decline in image quality caused by adherence of carrier to a photoreceptor, are provided. An angle α is in a range of no less than 45 degrees nor more than 57 degrees, which is formed between a plane comprising a central line of magnetic pole formed by a regulating pole in a magnet roller and a rotating central axis of a developing sleeve and a plane comprising a central line of magnetic pole formed by a pumping pole and a rotating central axis of the developing sleeve. Further, an absolute value of the maximum value of strength of the magnetic pole formed by a main pole is in a range of no less than 120 mT nor more than 140 mT.

9 Claims, 5 Drawing Sheets

DEVELOPING DEVICE AND IMAGE FORMING APPARATUS HAVING THE SAME

CROSS-REFERENCE TO RELATED APPLICATION

This application claims priority to Japanese Patent Application No. 2007-145887, which was filed on May 31, 2007, the contents of which are incorporated herein by reference in its entirety.

BACKGROUND OF THE INVENTION

1. Field of the Invention

The present invention relates to a developing device having a developing roller for bearing and conveying a two-component developer and a layer-thickness regulating member for regulating a layer-thickness of the two-component developer which the developing roller conveys, and to an image forming apparatus having the same.

2. Description of the Related Art

In an electrophotographic image forming process, an electrostatic latent image bearing body uniformly charged is exposed to light corresponding to image information so that an electrostatic latent image is formed on the electrostatic latent image bearing body, and the electrostatic latent image is visualized by a developing device. In order to develop the electrostatic latent image, there have been employed one-component developing method using a magnetic or nonmagnetic one-component developer and a two-component developing method using a two-component developer composed of a toner and a carrier.

In the two-component developing method, a magnetic particle referred to as a carrier and a toner are agitated so that both are charged by a mutual friction therebetween. In this way, the toner is borne on a surface of the carrier. On a surface of a developing sleeve where a magnet is housed internally, the carrier having borne the toner forms into a projection referred to as an ear. The toner included in the ear moves from the developing sleeve to the electrostatic latent image on the electrostatic latent image bearing body, whereby the electrostatic latent image is developed (for example, refer to Japanese Examined Patent Publication JP-B2 3305138).

A device used in the two-component developing method is slightly more complicated than that used in the one-component developing method. However, the two-component developing method is commonly used because of its relative easiness in setting an electric potential of toner and excellence in high-speed responsiveness and stability.

In a device for developing by the two-component developing method where a developing sleeve conveys the developer upwardly in a vertical direction, there exists a problem that a difference in image density occurs between anterior end and posterior end of paper in a print direction.

In order to resolve the problem mentioned above, an art has been disclosed by Japanese Unexamined Patent Publication JP-A 2002-148942, for example. The developing device described in JP-A 2002-148942 is so designed as to restrain the developer having been used for development and stripped from the surface of the developing sleeve from being immediately fed to the developing sleeve and used for development. By doing so, the developing device described by JP-A 2002-148942 prevents density of an image to be formed from declining, thus making it possible to obtain an image having a sufficient image density.

A magnet member having a plurality of magnetic poles is fixedly disposed on an internal side of a cylindrical developing sleeve, a developer composed of a toner and a magnetic carrier is fed to the surface of the developing sleeve by a feeding member, and a development is carried out by rotating the developing sleeve to convey the developer to a developing region facing an image bearing body. The developer having been used for development is sent back into the main body of the device, and is stripped off from the surface of the developing sleeve by a pair of adjacent stripping poles which have the same polarity and are disposed on the above-described magnet member.

The developing sleeve is so rotated that the developer having been used for development is conveyed downwardly in the main body of the device, and an upstream pole having different polarity is so disposed in the magnet member as to be located upstream of the pair of the stripping poles in the rotation direction of the developing sleeve. When assuming a peak value to be A (mT) of perpendicular magnetic force of the upstream pole, assuming a peak value to be B (mT) of perpendicular magnetic force of the first stripping pole located upstream of the rotation direction of the developing sleeve, assuming an angle to be θ1 degree(s) formed among a position a1 where the perpendicular magnetic force of the upstream pole is maximized, a center o of the aforementioned magnet member, and a position a2 where a perpendicular magnetic force between the upstream pole and the first stripping pole is 0 mT, and assuming an angle to be θ2 degree(s) formed among the aforementioned position a2 where the perpendicular magnetic force is 0 mT, the center o of the magnet member, and a position a3 where the aforementioned first stripping pole is maximized, the following formula is satisfied:

$$(A+B)/(\theta 1+\theta 2) \geqq 3.0$$

$$2.5>(A/\theta 1)/(B/\theta 2)>1.0$$

However, in the developing device described by JP-A 2002-148942, the developing sleeve has a larger amount of developer in its middle portion than its two end portions, thereby causing a problem that density irregularity occurs in a direction perpendicular to a print direction. Further, there exists a problem that deterioration in image quality ultimately caused by the adherence of the carrier to the photoreceptor occurs owing to the carrier on printing paper.

SUMMARY OF THE INVENTION

An object of the invention is to provide a developing device and an image forming apparatus capable of restraining density irregularity and restraining deterioration in image quality caused by adherence of carrier to a photoreceptor.

The invention provides a developing device comprising:

a developing roller having a sleeve and a magnet roller, for bearing and conveying a two-component developer composed of a toner and a carrier, the sleeve being rotatably disposed facing a photoreceptor where an electrostatic latent image is formed, the magnet roller being fixedly disposed inside the sleeve to form a plurality of magnetic poles; and a layer-thickness regulating member disposed facing the developing roller, for regulating a layer-thickness of the two-component developer conveyed by the developing roller, wherein the magnet roller has a main pole for forming a magnetic pole in a developing region for feeding the toner to the photoreceptor, a regulating pole arranged upstream of the magnetic pole formed by the main pole in a rotation direction of the sleeve and so positioned as to be closest to the layer-thickness regulating member, and a pumping pole disposed for pumping the two-component developer upwardly in a vertical direction, wherein an angle α is in a range of no less than 45 degrees nor more than 57 degrees, which is formed between a plane comprising a central line of a magnetic pole formed by the regulating pole and a rotating central axis of the sleeve and a plane comprising a central line of a magnetic pole formed by the pumping pole and the rotating central axis of the sleeve, and wherein an absolute value of a maximum value of strength of a magnetic pole formed by the main pole is in a range of no less than 120 mT nor more than 140 mT.

Further, in the invention, it is preferable that a number of magnetic poles which belong to the magnet roller is five or seven.

Further, in the invention, it is preferable that an absolute value of a difference between the maximum value of strength of a magnetic pole formed by the regulating pole and the maximum value of strength of a magnetic pole formed by the pumping pole is in a range of no less than 22.5 mT nor more than 35.0 mT, when the number of magnetic poles is five.

Further, in the invention, it is preferable that the angle α is in a range of no less than 47 degrees nor more than 57 degrees, when the number of magnetic poles is five.

Further, in the invention, it is preferable that an absolute value of a difference between the maximum value of strength of a magnetic pole formed by the regulating pole and the maximum value of strength of a magnetic pole formed by the pumping pole is in a range of no less than 7.0 mT nor more than 9.0 mT, when the number of magnetic poles is seven.

Further, in the invention, it is preferable that the angle α is in a range of no less than 45 degrees nor more than 51 degrees, when the number of magnetic poles is seven.

Further, in the invention, it is preferable that an angle θ is greater than 0 degree and 5 degrees or less which is formed between a plane comprising a central line of the magnetic pole formed by the main pole and the rotating central axis of the sleeve and a plane comprising the rotating central axis of the sleeve and a rotating central axis of the photoreceptor, and a position where strength of the magnetic pole is maximized is arranged upstream of the developing region.

Further, the invention provides an image forming apparatus having the developing device.

According to the invention, a magnet roller has a main pole, a regulating pole, and a pumping pole for pumping a two-component developer upwardly in a vertical direction. The main pole forms a magnetic pole in a developing region for feeding a toner to a photoreceptor. The regulating pole is disposed upstream of the magnetic pole formed by the main pole in a rotation direction of a sleeve and is so positioned as to be closest to a layer-thickness regulating member.

Here, an angle α is set to be in a range of no less than 45 degrees nor more than 57 degrees which is formed between a plane comprising a central line of a magnetic pole formed by the regulating pole and a rotating central line of the sleeve and a plane comprising a central line of a magnetic pole formed by the pumping pole and the rotating central line of the sleeve.

Further, an absolute value of strength of the magnetic pole formed by the main pole is set to be in a range of no less than 120 mT nor more than 140 mT.

By setting the angle α to be 57 degrees or less, it is possible, in the whole sleeve, to smoothly convey the developer from the pumping pole to the regulating pole and to restrain density irregularity caused by poor conveyance of developer from occurring in a direction perpendicular to a print direction. On the other hand, when the angle α is less than 45 degrees, poor conveyance of developer can be restrained. However, in order to attain to a target amount of conveyance, it is necessary to limit a large amount of developers by a layer-thickness regulating member. This causes developer deterioration.

When the absolute value of the maximum value of strength of the magnetic pole of the main pole is 120 mT or more, it is possible to restrain the carrier from adhering to the photoreceptor with the toner, thus making it possible to prevent image deterioration caused by the carrier in the printed image from occurring and prevent amount of developer from declining. When the absolute value mentioned above exceeds 140 mT, there is not a significant change in the effect of restraining the carrier from adhering to the photoreceptor. However, in this case, conveyance of developer from the main pole to the subsequent pole deteriorates and the replacement of developers on the sleeve with undeveloped developers cannot be smoothly carried out, thereby causing a decline in image density.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
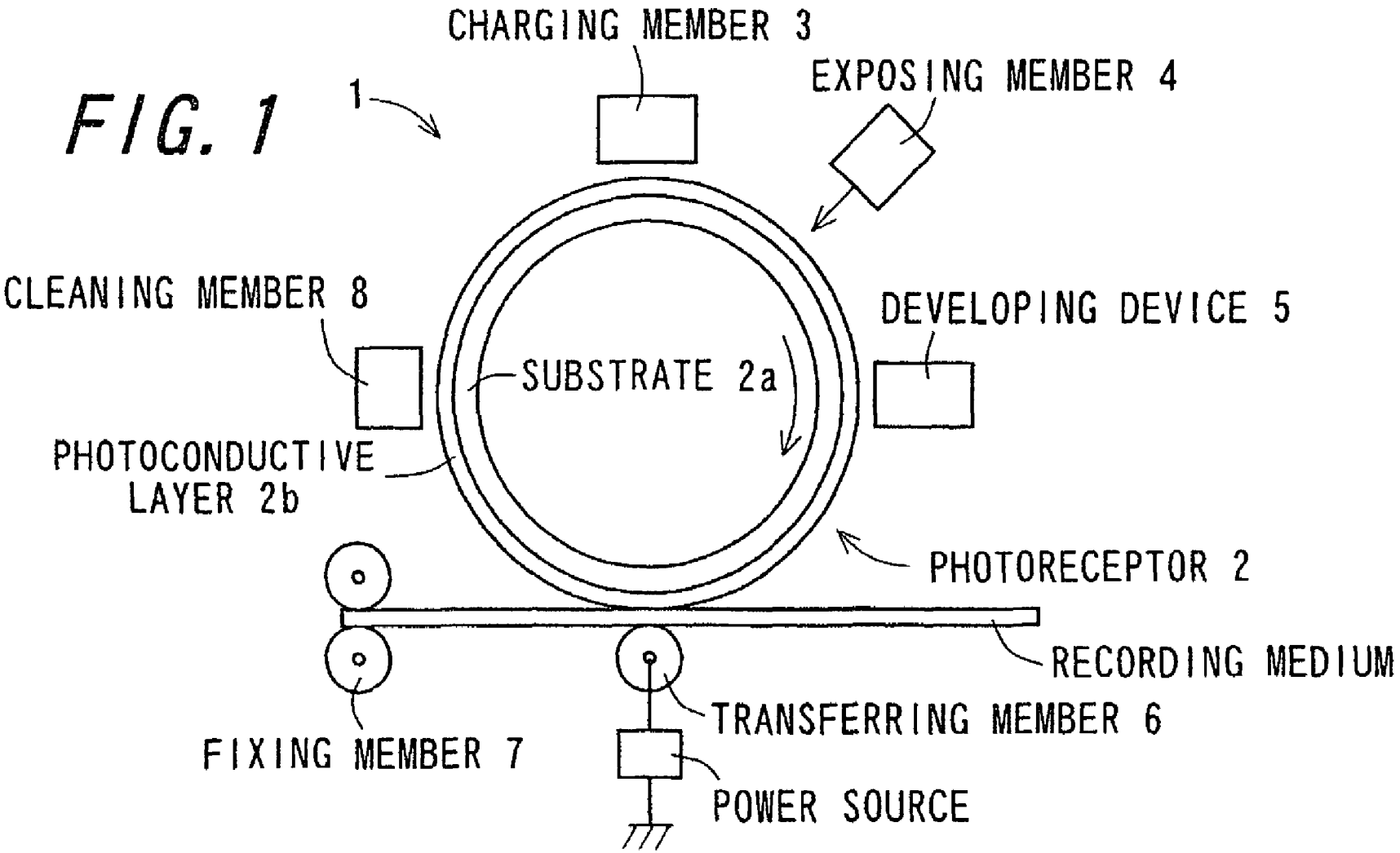
FIG. 1 is a sectional view showing a constitution of an image forming apparatus according to one embodiment of the invention.

Now referring to the drawings, preferred embodiments of the invention are described below.

FIG. 1 is a sectional view showing a constitution of an image forming apparatus 1 according to one embodiment of the invention. The image forming apparatus 1 includes a photoreceptor 2, a charging member 3, an exposing member 4, a developing device 5, a transferring member 6, a fixing member 7, and a cleaning member 8.

The photoreceptor (an image bearing body) 2 can be used which is composed of a metallic drum such as aluminum serving as a substrate 2*a* and a thin photoconductive layer 2*b* formed on a outer peripheral surface of the substrate 2*a*. Examples of the photoconductive layer 2*b* include an organic photoconductive (OPC) layer and an amorphous silicon (a-Si) layer.

Examples of the charging member 3 used include a corona charger which is composed of a charging wire such as tungsten wire, a metallic shielding plate, and a grid plate, a charging roller, and a charging brush. The exposing member 4 used includes a light source for emitting laser light, a light scanning unit for scanning the emitted light, and so forth. The exposing member 4 exposes the photoreceptor 2 to light in accordance with image information obtained from an information retrieving portion, to form an electrostatic latent image.

The developing device 5, which will be described in detail later, charges a two-component developer stored therein and feed the charged two-component developer to a surface of the photoreceptor 2, so as to develop an electrostatic latent image. The transferring member 6 transfers a toner image developed on the surface of the photoreceptor 2 onto a surface of a recording medium such as paper. The cleaning member 8 is used for cleaning the photoreceptor 2 by scraping off the toner which has failed to be transferred onto the recording medium and remained on the surface of the photoreceptor 2.

Firstly, the photoreceptor 2 is charged uniformly by the charging member 3. And then, the photoreceptor 2 is exposed to light irradiated by the exposing member 4 in accordance with the image information, and the electrostatic latent image is formed on the photoreceptor 2. The developer (toner) inside the developing device 5 moves due to a development field (a bias power source provided in the developing device is not shown in the figure) formed between the photoreceptor 2 and the developing device 5, and the electrostatic latent image formed on the photoreceptor 2 is visualized as a toner image. The toner image is transferred onto the recording medium by a transferring member (for example, a transferring roller), and is heated and pressurized by a fixing member so as to be fixed. After the toner image has been transferred, the toner remained on the photoreceptor is removed by the cleaning member and the photoreceptor 2 is charged uniformly by the charging member again. The above-described process is repeated.

Figure 2:
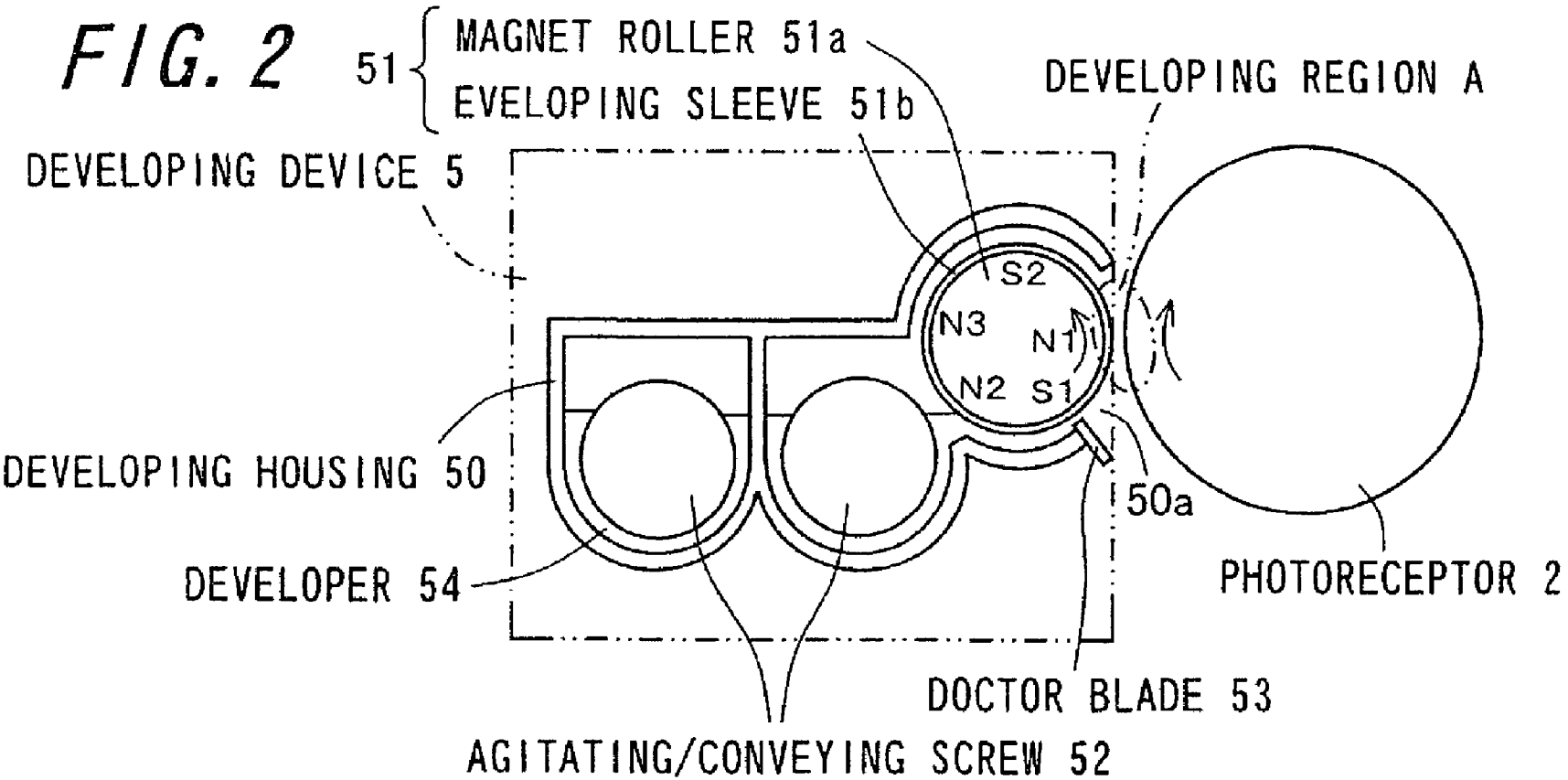
FIG. 2 is a sectional view showing a constitution of a developing device.

FIG. 2 is a sectional view showing a constitution of the developing device 5.

A developing housing 50 is a vessel member having an internal space therein. The developing housing 50 rotatably supports a developing roller 51 and an agitating/conveying screw 52, directly or indirectly supports a doctor blade 53 and so forth which is a layer-thickness regulating member, and houses a developer 54 inside its internal space.

The developer 54 is a two-component developer composed of a toner and a carrier which is magnetic powder. In addition, the developing housing 50 has an opening 50*a* formed in its side surface facing the photoreceptor 2.

The developing roller 51 is a roller-like member at least a part of which is rotatably borne by the developing housing 50 and which is rotated about its center of axle by a driving portion (not shown). Further, the developing roller 51 faces the photoreceptor 2 via the opening 50*a* of the developing housing 50. The developing roller 51 is so disposed as to be spaced from the photoreceptor 2 with a gap secured therebetween, and the most adjacent part therebetween is a developing region A. In the developing region A, the toner is fed to the electrostatic latent image on the surface of the photoreceptor 2 from the developer layer on the surface of the developing roller 51. In the developing region A, a bias voltage for developing is applied to the developing roller 51 from a electric power source (not shown) which is connected to the developing roller 51, whereby the toner is smoothly moved from the developer layer on the surface of the developing roller 51 to the electrostatic latent image on the surface of the photoreceptor 2.

The developing roller 51 is composed of a magnet roller 51*a* and a developing sleeve 51*b*. The magnet roller 51*a* is a multipolar magnetizing magnet roller having its two ends in its longitudinal direction supported by a wall of the vessel. In the circumferential direction of the developing roller 51, the magnet roller 51*a* is provided with a plurality of sectionally-rectangular bar-magnets. The bar-magnets are radially-arranged in a radial direction so that their magnetic poles N1, N2, N3, S1, and S2 are spaced from each other. The respective magnetic poles are disposed beginning from the developing region A in the order of N1, S1, N2, N3, and S2 in a direction opposite to a rotation direction of the developing sleeve 51*b*.

The developing sleeve 51*b* is a cylindrical member, which is externally fitted on the magnet roller 51*a*, is rotatably supported by the developing housing 50, and is so disposed as to be rotatably driven by a driving portion (not shown). The developing sleeve 51*b* is formed of non-magnetic materials. In the present embodiment, the developing sleeve 51*b* rotates in a counterclockwise direction and the photoreceptor 2 rotates in a clockwise direction. Therefore, the sleeve 14 and a photoreceptor drum 20 rotate in the same direction in the developing region A.

No particular limitation is imposed on the material of the developing sleeve 51*b* if the material is nonmagnetic. Examples of the material used include aluminum, SUS302, SUS303, SUS304, SUS304Cu, SUS304L, SUS304N1, SUS304J3, SUS305, SUS305J1, SUS309S, SUS310S, SUS316, SUS316L, SUS316N, SUS316Ti, SUS316J1, SUS316F, SUS317, SUS317F, SUS321, and SUS347.

Further, the developing sleeve 51*b* functions in a way of so-called pumping development where a part of developing sleeve 51*b* uncovered by the developing housing rotates upwardly in a vertical direction.

Further, the doctor blade 53 is arranged just in front of the developing region A in the rotation direction of the developing sleeve 51*b*, and regulates a thickness of the developer layer when the developer is pumped up.

The developer 54 used in the invention has a toner particle diameter of 6.2 μm and a carrier particle diameter of 45 μm, for example. However, other developers also can be used.

In the invention, magnetic poles of the magnet roller 51*a* are formed of five poles as mentioned above, or seven poles.

Figure 3:
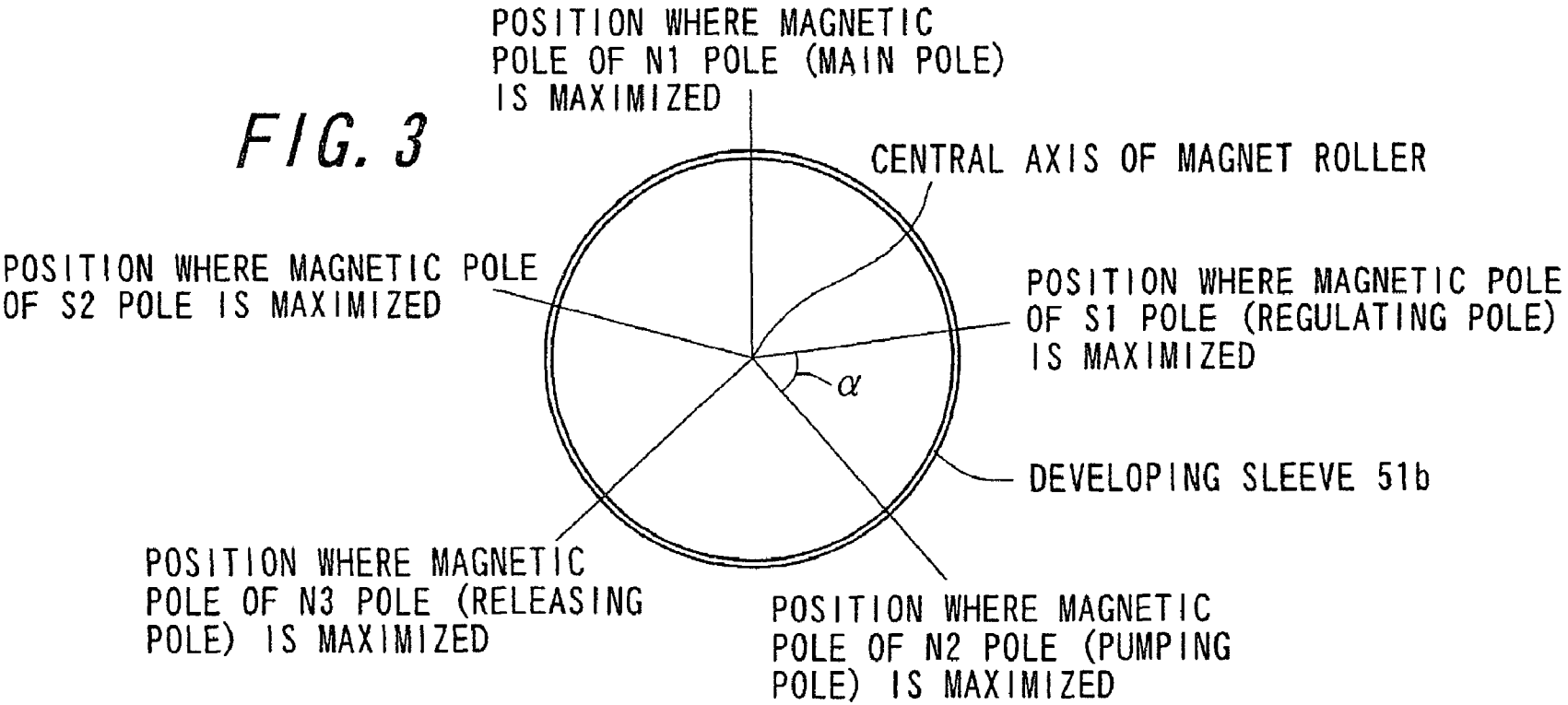
FIG. 3 is a view showing an arrangement of magnetic poles of a magnet roller in the case of five poles.

FIG. 3 is a view showing an arrangement of magnetic poles of the magnet roller 51*a* in the case of five poles.

When the magnet roller 51*a* has five poles, the five poles include an N1-pole (a main pole) positioned in the developing region A, an S1-pole (a regulating pole) positioned near to the doctor blade 53, for exerting influence on the regulation of the layer-thickness of the developer layer, an N2-pole (a pumping pole) disposed for pumping the developer up, an N3-pole (a releasing pole) disposed for releasing the developer which has been used for development, and an S2-pole.

Figure 4:
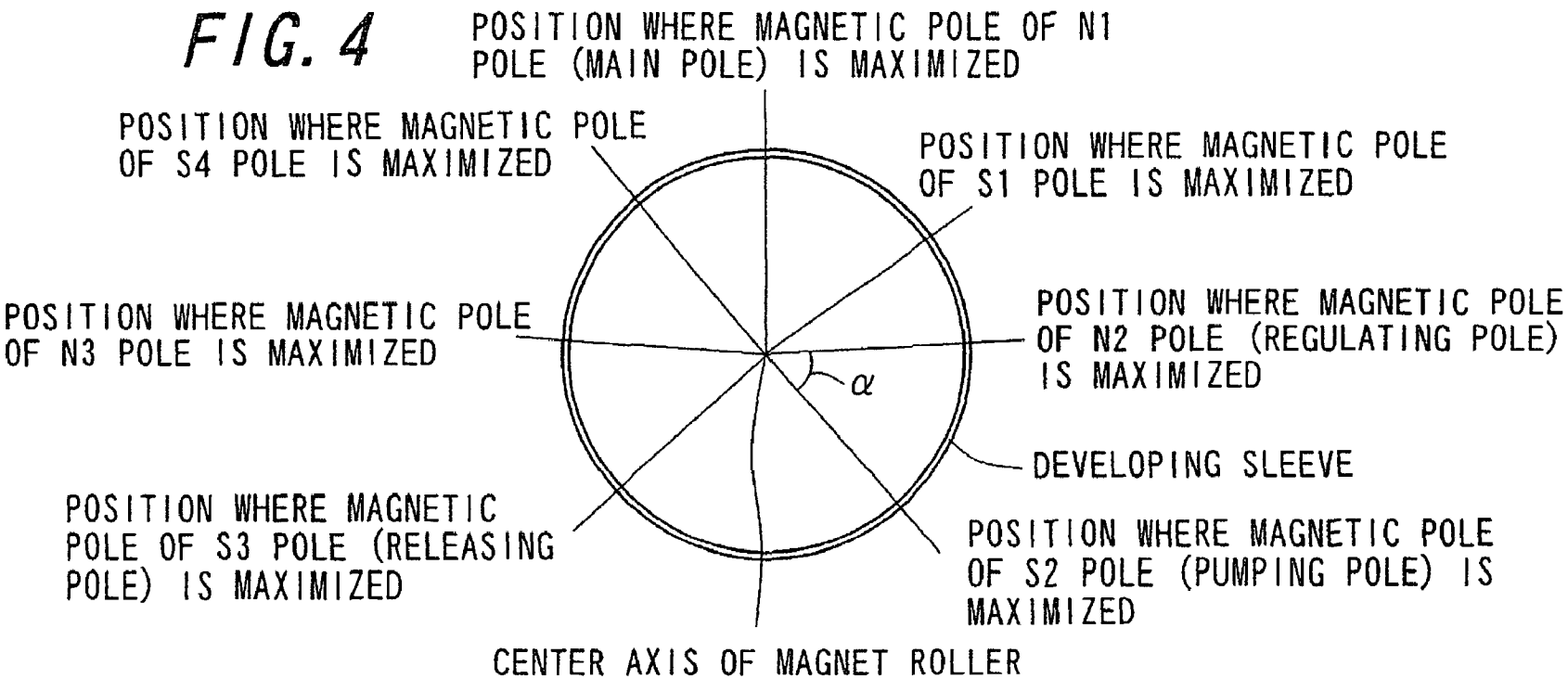
FIG. 4 is a view showing an arrangement of magnetic poles of a magnet roller in the case of seven poles.

FIG. 4 is a view showing an arrangement of magnetic poles of the magnet roller 51*a* in the case of seven poles.

When the magnet roller 51*a* has seven poles, the seven poles include an N1-pole (a main pole) positioned in the developing region A, an N2-pole (a regulating pole) positioned near to the doctor blade 53, an S2-pole (a pumping pole) for pumping the developer up, and an S3-pole (a releasing pole) for releasing the developer, and further include an S1-pole, an N3-pole, and an S4-pole.

In the invention, the arrangement of the regulating pole and the pumping pole is specified in the magnet roller 51*a*.

An angle α is selected to be in a range of no less than 45 degrees nor more than 57 degrees, which is formed between a plane comprising a central line of a magnetic pole formed in the magnet roller 51*a* by the regulating pole and a rotating central axis of the developing sleeve 51*b* and a plane comprising a central line of a magnetic pole formed by the pumping pole and the rotating central axis of the developing sleeve 51*b*. The central line of magnetic pole refers to a line segment which connects the rotating central axis of the developing sleeve 51*b* and a position where strength of one of the magnetic poles is maximized.

By setting the angle α to be 57 degrees or less, it is possible, in the whole developing sleeve 51*b*, to smoothly convey the developer from the pumping pole to the regulating pole, and to restrain density irregularity caused by poor conveyance of developer from occurring in a direction perpendicular to a print direction. When the angle α is less than 45 degrees, it is possible to restrain the poor conveyance of developer from occurring. At this case, however, it is necessary to limit a large amount of developers using the doctor blade 53 in order to attain to a target amount of conveyance, thus causing developer deterioration. Therefore, the angle α is preferably selected to be in a range of no less than 45 degrees nor more than 57 degrees.

When the magnet roller 51*a* has five poles, the angle α is preferably selected to be in a range of no less than 47 degrees nor more than 57 degrees. When the magnet roller 51*a* has seven poles, the angle α is particularly preferably selected to be in a range of no less than 45 degrees nor more than 51 degrees.

Further, an absolute value of the maximum value of strength of a magnetic pole formed by the main pole N1 is in a range of no less than 120 mT nor more than 140 mT.

When the absolute value of the maximum value of strength of the magnetic pole formed by the main pole is 120 mT or more, it is possible to restrain the carrier from adhering to the photoreceptor 2 with the toner, thereby making it possible to prevent image deterioration induced by the carrier in printed image from occurring and to prevent amount of developer from declining. When the absolute value of the main pole strength exceeds 140 mT, there is not a significant change in the effect of restraining the carrier from adhering to the photoreceptor 2. At this case, however, the conveyance of developer from the main pole to the releasing pole deteriorates and the replacement of the developer on the developing sleeve 51*b* with undeveloped developers cannot be smoothly carried out, thereby causing a decline in image density. Therefore, the absolute value of the maximum value of strength of the magnetic pole formed by the main pole is preferably selected to be in a range of no less than 120 mT nor more than 140 mT.

Further, when the magnet roller 51*a* has five poles, an absolute value of a difference is in a range of no less than 22.5 mT nor more than 35.0 mT between the maximum value of strength of a magnetic pole formed by the regulating pole and the maximum value of strength of a magnetic pole formed by the pumping pole.

It is necessary to set the angle α to be larger in the case of five poles compared with the case of seven poles. When the absolute value of the difference mentioned above is 22.5 mT or more in the case of five poles, it is possible, in the whole developing sleeve, to smoothly convey the developer from the pumping pole to the regulating pole and to restrain density irregularity caused by poor conveyance of developer from occurring in the direction perpendicular to the print direction. When the absolute value of the difference exceeds 35.0 mT, it is possible to restrain the poor conveyance of developer from occurring. At this case, however, it is necessary to limit a large amount of developers using the doctor blade 53 in order to attain to a target amount of conveyance, and developer deterioration occurs. Therefore, the absolute value of the difference is preferably selected to be in a range of no less than 22.5 mT nor more than 35.0 mT between the maximum value of strength of the magnetic pole formed by the regulating pole and that of strength of the magnetic pole formed by the pumping pole.

Further, when the magnet roller 51*a* has seven poles, the absolute value of the difference is in a range of no less than 7.0 mT nor more than 9.0 mT between the maximum value of strength of the magnetic pole formed by the regulating pole and that of strength of the magnetic pole formed by the pumping pole.

In the case of seven poles, it is not necessary to set the angle α to be large. When the absolute value of the difference is 7.0 mT or more, it is possible, in the whole developing sleeve, to smoothly convey the developer from the pumping pole to the regulating pole, and to restrain density irregularity caused by poor conveyance of developer from occurring in the direction perpendicular to the print direction. When the absolute value of the difference exceeds 9.0 mT, it is possible to restrain the poor conveyance of developer from occurring. At this case, however, it is necessary to limit a large amount of developers using the doctor blade 53 in order to attain to a target amount of conveyance, and developer deterioration occurs. Therefore, the difference of the absolute value in the maximum value of strength of the magnetic pole is preferably selected to be in a range of no less than 7.0 mT nor more than 9.0 mT.

Note that it is possible to convey the developer smoothly and restrain the density irregularity from occurring during printing, by setting the number of magnetic pole to be five when a diameter of the developing sleeve 51*b* is approximately 20 mm and setting the number of magnetic pole to be seven when the diameter of the developing sleeve 51*b* is approximately in a range of no less than 30 mm nor more than 50 mm.

It is possible to effectively prevent the carrier from adhering to the photoreceptor 2 and the density irregularity from occurring by regulating an arrangement position of the main pole.

Figure 5:
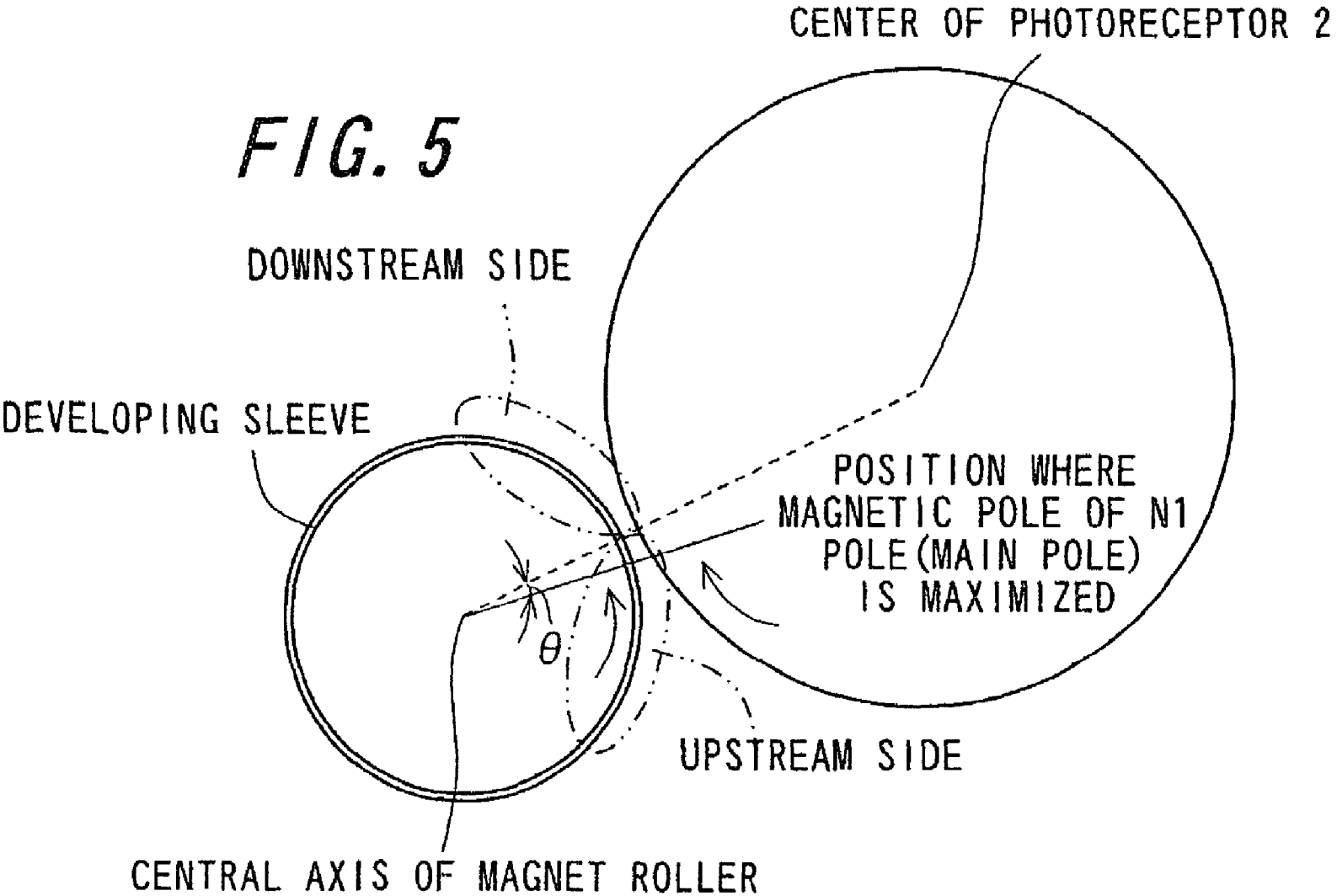
FIG. 5 is a view showing a preferred arrangement position of a main pole N1.

FIG. 5 is a view showing a preferred arrangement position of the main pole N1.

The main pole N1 is so disposed that an angle θ is greater than 0 degree and 5 degrees or less formed between a plane comprising a central line of a magnetic pole formed by the main pole and a rotating central axis of the photoreceptor 2 and a plane comprising the rotating central axis of the developing sleeve 51*b* and the rotating central axis of the photoreceptor 2.

The main pole is positioned upstream in the rotation direction of the developing sleeve 51*b* relative to the plane comprising the rotating central axis of the developing sleeve 51*b* and the rotating central axis of the photoreceptor 2, whereby it is possible to prevent it from occurring that the releasing pole approaching the plane comprising the rotating central axis of the developing sleeve 51*b* and the rotating central axis of the photoreceptor 2 causes the used developers to be confined in the vicinity of the main pole for a long time. This makes it possible to convey the developer to the releasing pole smoothly and restrain the carrier from adhering to the photoreceptor 2, thereby making it possible to prevent the image deterioration resulted from the carrier in the printed image from occurring and to prevent the amount of developer from declining. However, when the angle θ exceeds 5 degrees, the conveyance of developer becomes unstable, thereby resulting in that density irregularity easily occurs in the printed image.

EXAMPLES

Image formation on A4 recording paper was carried out under the following conditions by using a copying machine (trade name: MX-7000N; manufactured by Sharp Corporation). The used copying machine corresponds to the image forming apparatus 1 having the developing device 5 according to the invention.

In Examples 1-16 according to the invention, all of the number of magnetic poles, the maximum value of the strength of the magnetic pole formed by the main pole, the angle α, and the position of the main pole remain in the ranges specified by the invention. On the other hand, for Comparative Examples 1-12, at least one of the number of magnetic poles, the maximum value of strength of the magnetic pole formed by the main pole, the angle α, and the position of the main pole is not within the ranges specified by the invention. The magnet roller 51*a* having a magnetism distribution shown in Table 1 was incorporated into the developing device 5 of the copying machine, and Examples 1-16 of the invention and Comparative Examples 1-12 were tested.

(Density Irregularity)

In order to evaluate density irregularity in a direction perpendicular to a print direction, a whole solid image was printed on the A4 paper and a density at the center of the paper and a density in direction perpendicular to the print direction were measured by using a portable spectrophotometer (trade name: X-Rite 939; manufactured by X-Rite Company). Note that evaluations "Excellent", "Good", "Not bad", and "Poor" are used to show results of evaluation on the density irregularity. The evaluation "Excellent" represents that a density difference between the center thereof and a position above or below the center (the larger density difference is adopted) is less than 100 and the density difference cannot be visually identified at all. The evaluation "Good" represents that the density difference mentioned above is 100 or more and less than 150 and the density difference almost cannot be visually identified. The evaluation "Not bad" represents that the density difference is 150 or more and less than 200, and a thin spot in the direction perpendicular to the print direction approximately cannot be observed although the density difference can be approximately identified visually. In addition, the evaluation "Poor" represents that the density difference is 200 or more, the density difference is visually obvious, and the thin spot in the vertical direction of the printing paper is also obvious.

(Carrier Adherence)

In order to evaluate the adherence of carrier to the photoreceptor, a number of carriers on the photoreceptor was measured during printing the whole solid image on the A4 paper. A tape having a size of 18 mm×360 mm (trade name: Mending Tape CAT No. 810-8-18; manufactured by Sumitomo 3M Limited) is put up in an axial direction of the photoreceptor and the number of carriers adhering to the tape was measured. Note that evaluations "Excellent", "Good", "Not bad", and "Poor" are used to represent results of evaluation on the carrier adherence. The evaluation "Excellent" represents that the number of carriers adhering to the tape is less than five and image deterioration induced by the carriers adhering to the printing paper cannot be identified at all. The evaluation "Good" represents that the number of carriers adhering to the tape is five or more and less than ten and image deterioration induced by the carriers adhering to the printing paper almost cannot be identified. The evaluation "Not bad" represents that the number of carriers adhering to the tape is ten or more and less than twenty and image deterioration induced by the carriers adhering to the printing paper can be identified. In addition, the evaluation "Poor" represents that the number of carriers adhering to the tape is twenty or more and image deterioration induced by the carriers adhering to the printing paper is obvious.

(Developer Deterioration)

In order to evaluate developer deterioration, flowability of the developer was measured by using a flowability measuring apparatus (trade name: vibration-transporting flowabllity measuring apparatus; manufactured by ETWS Company) after an image having a printing coverage of 5% has been printed to make 10,000 copies using the copying machine (trade name: MX-7000N; manufactured by Sharp Corporation) so as to apply sufficient load to the developer.

By using 2 grams of the developers, a starting time at which the developer begins to flow out was measured at a voltage of 60 V and a vibration frequency of 137 Hz. Note that evaluations "Excellent", "Good", "Not bad", and "Poor" are used to represent results of evaluation on the developer deterioration. At this time, a transfer time (starting time at which the developer begins to flow out) of 2 grams of unused developers was less than 5 minutes. Taking this matter into consideration, the evaluation "Excellent" represents that the starting time at which the developer begins to flow out is less than 5 minutes, and the developer does not deteriorate at all remaining at the same level as its initial stage. The evaluation "Good" represents that the starting time at which the developer begins to flow out of the developer is less than 7 minutes, and developer deterioration can be identified but does not causes a decline in image quality. The evaluation "Not bad" represents that the starting time at which the developer begins to flow out of the developer is less than 10 minutes and spot of solid image caused by developer deterioration occurs. The evaluation "Poor" represents that the starting time at which the developer begins to flow out of the developer is 10 minutes or more, and a white streak of solid image occurs owing to severe developer deterioration.

(Comprehensive Evaluation)

Note that evaluations "Excellent", "Good", "Not bad", and "Poor" are used to represent results of comprehensive evaluation. The evaluation "Excellent" represents that the developer deteriorates slowly and the developer after having been used for making 10,000 copies remains at the same level as its initial stage in respect of density irregularity and carrier adherence. The evaluation "Good" represents that the developer after having been used for making 7,500 copies remains at the same level as its initial stage in respect of density irregularity and carrier adherence. The evaluation "Not bad" represents that the developer after having been used for making 7,500 copies becomes worse than its initial stage in respect of density irregularity and carrier adherence, and a decline in image quality can be identified. The evaluation "poor" represents that the developer after having been used for making 5,000 copies becomes worse than its initial stage in respect of density irregularity and carrier adherence, and a decline in image quality can be identified.

TABLE 1

| | Number of Magnetic poles | Strength of Magnetic pole formed by Main pole mT | Angle between Pumping pole and Regulating pole (Degree) | Difference in strength of magnetic pole between Pumping pole and Regulating pole mT: | Position of Main pole (Degree: | Density irregularity | Carrier adherence | Developer deterioration | Comprehensive evaluation |
|---|---|---|---|---|---|---|---|---|---|
| Ex. 1 | 5 | 131.8 | 55.21 | 30.3 | 3 | Excellent | Excellent | Excellent | Excellent |
| Ex. 2 | 5 | 139.6 | 49.2 | 34.4 | 3 | Good | Excellent | Excellent | Good |
| Ex. 3 | 5 | 120.3 | 49.88 | 34.0 | 3 | Good | Good | Excellent | Good |
| Ex. 4 | 5 | 126.7 | 56.97 | 26.0 | 3 | Excellent | Good | Good | Good |
| Ex. 5 | 5 | 121.7 | 47.07 | 32.4 | 3 | Good | Good | Excellent | Good |

TABLE 1-continued

| | Number of Magnetic poles | Strength of Magnetic pole formed by Main pole mT | Angle between Pumping pole and Regulating pole (Degree) | Difference in strength of magnetic pole between Pumping pole and Regulating pole mT: | Position of Main pole (Degree: | Density irregularity | Carrier adherence | Developer deterioration | Comprehensive evaluation |
|---|---|---|---|---|---|---|---|---|---|
| Ex. 6 | 5 | 121.5 | 49.79 | 34.9 | 3 | Excellent | Good | Good | Good |
| Ex. 7 | 5 | 131.2 | 53.03 | 22.6 | 3 | Good | Excellent | Excellent | Good |
| Ex. 8 | 5 | 131.8 | 55.21 | 30.3 | 0.5 | Excellent | Good | Good | Good |
| Ex. 9 | 5 | 131.8 | 55.21 | 30.3 | 5 | Excellent | Excellent | Excellent | Excellent |
| Ex. 10 | 7 | 129.0 | 48.32 | 8.1 | 3 | Excellent | Excellent | Excellent | Excellent |
| Ex. 11 | 7 | 138.9 | 49.25 | 7.7 | 3 | Excellent | Excellent | Excellent | Excellent |
| Ex. 12 | 7 | 120.1 | 46.12 | 7.5 | 3 | Good | Good | Excellent | Good |
| Ex. 13 | 7 | 127.6 | 50.73 | 8.0 | 3 | Excellent | Good | Excellent | Good |
| Ex. 14 | 7 | 122.2 | 45.12 | 7.2 | 3 | Excellent | Excellent | Excellent | Excellent |
| Ex. 15 | 7 | 132.0 | 47.57 | 9.0 | 2 | Excellent | Excellent | Good | Good |
| Ex. 16 | 7 | 128.6 | 46.39 | 7.0 | 3 | Good | Excellent | Excellent | Good |
| Ex. 17 | 7 | 129.0 | 48.32 | 8.1 | 0.5 | Excellent | Excellent | Excellent | Excellent |
| Ex. 18 | 7 | 129.0 | 48.22 | 8.1 | 5 | Excellent | Excellent | Excellent | Excellent |
| Comp. Ex. 1 | 5 | 141.0 | 55.33 | 25.5 | 3 | Poor | Excellent | Not bad | Poor |
| Comp. Ex. 2 | 5 | 119.5 | 47.22 | 25.0 | 3 | Good | Not bad | Excellent | Not bad |
| Comp. Ex. 3 | 5 | 131.0 | 57.23 | 33.0 | 3 | Poor | Excellent | Poor | Poor |
| Comp. Ex. 4 | 5 | 122.5 | 46.88 | 36.5 | 3 | Excellent | Good | Poor | Poor |
| Comp. Ex. 5 | 5 | 132.1 | 50.23 | 22.2 | 3 | Poor | Excellent | Excellent | Poor |
| Comp. Ex. 6 | 5 | 131.6 | 55.21 | 30.3 | 0 | Excellent | Not bad | Not bad | Poor |
| Comp. Ex. 7 | 5 | 131.8 | 55.21 | 30.3 | 5.5 | Poor | Excellent | Excellent | Poor |
| Comp. Ex. 8 | 7 | 140.3 | 50.65 | 8.0 | 3 | Not bad | Excellent | Good | Not bad |
| Comp. Ex. 9 | 7 | 119.7 | 47.28 | 7.1 | 3 | Excellent | Poor | Excellent | Poor |
| Comp. Ex. 10 | 7 | 120.6 | 44.37 | 7.4 | 3 | Poor | Excellent | Excellent | Poor |
| Comp. Ex. 11 | 7 | 130.4 | 47.26 | 9.1 | 3 | Good | Excellent | Not bad | Not bad |
| Comp. Ex. 12 | 7 | 128.8 | 48.71 | 8.9 | 3 | Not bad | Excellent | Good | Not bad |
| Comp. Ex. 13 | 7 | 129.0 | 48.32 | 8.1 | 0 | Excellent | Not bad | Good | Not bad |
| Comp. Ex. 14 | 7 | 129.0 | 48.32 | 8.1 | 5.5 | Poor | Excellent | Excellent | Poor |

When the maximum value (absolute value) of strength of the magnetic pole formed by the main pole was 120.3 mT (Example 3) or 139.6 mT (Example 2) in the case of five poles, the density irregularity, the carrier adherence, and the developer deterioration were evaluated as "Good" or "Excellent". On the other hand, when the maximum value thereof was 119.5 mT (Comparative Example 2), the carrier adherence was "Not bad" and when the maximum value thereof was 141.0 mT (Comparative Example 1), the density irregularity was evaluated as "Poor".

When the absolute value of the maximum value of strength of the magnetic pole formed by the main pole was 120.1 mT (Example 12) or 138.9 mT (Comparative Example 11) in the case of seven poles, the density irregularity, the carrier adherence, and the developer deterioration were evaluated as "Good" or "Excellent". On the other hand, when the maximum value thereof was 119.7 mT (Comparative Example 9), the carrier adherence was evaluated as "Poor", and when the maximum value thereof was 140.3 mT (Comparative Example 8), the density irregularity was evaluated as "Not bad". Consequently, this makes it clear that the maximum value of strength of the magnetic pole formed by the main pole is preferably in a range of no less than 120 mT nor more than 140 mT whether in the case of five poles or seven poles.

When the absolute value of the maximum value of strength of the magnetic pole formed by the main pole is 120 mT or more, it is possible to restrain the carrier from adhering to the photoreceptor with the toner, thus making it possible to prevent image deterioration caused by the carrier in the printed image from occurring and prevent amount of developer from declining. When the maximum value exceeds 140 mT, there is not a significant change in the effect of restraining the carrier from adhering to the photoreceptor. At this time, however, the conveyance of developer from the main pole to the releasing pole deteriorates and the replacement of the developers on the developing sleeve with undeveloped developers cannot be carried out smoothly, thereby causing a decline in image density. Therefore, the absolute value of the magnetic force on the sleeve surface of the main pole is preferably in a range of no less than 120 mT nor more than 140 mT.

When the angle $\alpha$ was 47.07 degrees (Example 5) or 56.97 degrees (Example 4) in the case of five poles, the density irregularity, the carrier adherence, and the developer deterioration were evaluated as "Good" or "Excellent". On the other hand, when the angle $\alpha$ was 57.37 degrees (Comparative Example 3), the density irregularity was evaluated as "Poor". In this case, intervals between poles are naturally broad because of a small number of magnetic poles, and the angles a between the pumping pole and the regulating pole at which no influence was exerted to the other poles was no less than 47 degrees. This makes it impossible to use a magnet roller having the angle $\alpha$ of less than 47 degrees.

When the angle $\alpha$ was 45.12 degrees (Example 14) or 50.73 degrees (Example 13) in the case of seven poles, the density irregularity, the carrier adherence, and the developer deterioration were evaluated as "Good" or "Excellent". On the other hand, when the angle $\alpha$ was 44.37 degrees (Comparative Example 10), the density irregularity was evaluated as "Poor". In the case of seven poles, intervals between poles cannot be broad because of a large number of magnetic poles, the angles $\alpha$ between the pumping pole and that of the regulating pole at which no influence was exerted to the other poles was up to 51 degrees. This makes it impossible to use a magnet roller having the angle $\alpha$ of greater than 51 degrees.

Consequently, this makes it obvious that the angle $\alpha$ is preferably in a range of no less than 45 degrees nor more than 57 degrees irrespective of the number of magnetic poles of the magnet roller.

By setting the angle α to be 57 degrees or less, it is possible, in the whole developing sleeve, to smoothly convey the developer from the pumping pole to the regulating pole and to restrain density irregularity caused by poor conveyance of developer from occurring in the direction perpendicular to the print direction. On the other hand, when the angle α is less than 45 degrees, it is possible to restrain poor conveyance of developer from occurring. At this time, however, in order to attain to a target amount of conveyance, it is necessary to limit a large amount of developers by using the doctor blade, and developer deterioration occurs. Therefore, it is preferable to select the angle α to be in a range of no less than 45 degrees nor more than 57 degrees.

Further, it is more preferable to select the angle α to be in a range of no less than 47 degrees nor more than 57 degrees in the case of five poles and to be in a range of no less than 45 degrees nor more than 51 degrees in the case of seven poles.

Compared with the case of seven poles, it is necessary to select the angle α to be larger in the case of five poles, and it is preferable to select the value of the angle α at which no influence is exerted to the other poles to be in the range of no less than 47 degrees nor more than 57 degrees. In the case of seven poles, it is not necessary to set the angle α to be large, and the angle α is optimally to be in the range of no less than 45 degrees nor more than 51 degrees.

When the difference (absolute value) between the maximum value of strength of the magnetic pole formed by the regulating pole and that of strength of the magnetic pole formed by the pumping pole was 22.6 mT (Example 7) or 34.9 mT (Example 6) in the case of five poles, the density irregularity, the carrier adherence, and the developer deterioration were evaluated as "Good" or "Excellent". On the other hand, when the difference mentioned above was 22.2 mT (Comparative Example 5), the density irregularity was evaluated as "Poor". In addition, when the difference mentioned above was 35.5 mT (Comparative Example 4), the developer deterioration was evaluated as "Poor".

In the case of seven poles, when the difference mentioned above was 7.0 mT (Example 16) or 9.0 mT (Example 15), the density irregularity, the carrier adherence, and the developer deterioration were evaluated as "Good" or "Excellent". On the other hand, when the difference mentioned above was 6.9 mT (Comparative Example 12), the carrier adherence was evaluated as "Not bad". In addition, when the difference mentioned above was 9.1 mT (Comparative Example 11), the developer deterioration was evaluated as "Not bad".

Consequently, this makes it obvious that the absolute value of the difference between the maximum value of strength of the magnetic pole formed by the regulating pole and that of strength of the magnetic pole formed by the pumping pole is preferable to be in a range of no less than 22.5 mT nor more than 35.0 mT, and more preferable to be in a range of no less than 7.0 mT nor more than 9.0 mT.

When the number of magnetic poles inside the developing sleeve is five, it is necessary to set the angle α to be larger than that in the case of seven poles. At this case, by setting the difference in the maximum value to be 22.5 mT or greater, it is possible, in the whole developing sleeve, to smoothly convey the developer from the pumping pole to the regulating pole and to restrain density irregularity caused by poor conveyance of developer from occurring in the direction perpendicular to the print direction. On the other hand, when the difference in the maximum value mentioned above exceeds 35.0 mT, it is possible to restrain poor conveyance of developer from occurring. At this case, however, it is necessary to limit a large amount of developers by using the doctor blade in order to attain to a target amount of conveyance, thus causing developer deterioration.

Contrary to the case of five poles, it is not necessary to set the angle α to be large in the case of five poles. By setting the difference in the maximum value to be 7.0 mT or more, it is possible, in the whole sleeve, to smoothly convey the developer from the pumping pole to the regulating pole and to restrain density irregularity caused by poor conveyance of developer from occurring. On the other hand, when the difference in the maximum value exceeds 9.0 mT, it is possible to restrain poor conveyance of developer from occurring. At this case, however, it is necessary to limit a large amount of developers by using the doctor blade in order to attain to a target amount of conveyance, thus causing developer deterioration.

As for the arrangement position of the main pole, when the angle θ was 0.5 degree (Example 8) or 5 degrees (Example 9) in the case of five poles, the density irregularity, the carrier adherence, and the developer deterioration were evaluated as "Good" or "Excellent". On the other hand, when the angle θ was 0 degree (Comparative Example 6), the carrier adherence and the carrier deterioration were evaluated as "Not bad". In addition, when the angle θ was 5.5 degrees (Comparative Example 7), the density irregularity was evaluated as "Poor".

In the case of seven poles, when the angle θ was 0.5 degree (Example 17) or 5 degrees (Comparative Example 18), the density irregularity, the carrier adherence, and the developer deterioration were evaluated as "Excellent". On the other hand, when the angle θ was 0 degree (Comparative Example 13), the carrier adherence was evaluated as "Not bad". In addition, when the angle θ was 5.5 degrees (Comparative Example 14), the density irregularity was evaluated as "Poor".

Consequently, this makes it obvious that the angle θ is preferably selected to be greater than 0 degree and 5 degrees or less as for the arrangement position of the main pole, whether in the case of five poles or seven poles.

By setting a position where the strength of the magnetic pole formed by the main pole is maximized to be in the upstream side, it is possible to restrain it from occurring that used developers can be undesirably conveyed to the releasing pole owing to the approaching of the releasing pole to the plane comprising a center of the magnet roller and a center of the photoreceptor. Further, it is possible to prevent image deterioration caused by the carrier in the printed image from occurring and amount of developer from declining. However, when the strength of the magnetic pole formed by the main pole is so positioned that the angle θ exceeds 5 degrees, conveyance of developer becomes unstable, thereby causing that the density irregularity in the printed image easily occurs. For this reason, it is necessary to set the angle θ to be greater than 0 degree and 5 degrees or less and to have the main pole in the upstream of the developing region.

The invention may be embodied in other specific forms without departing from the spirit or essential features thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device comprising:

a developing roller having a sleeve and a magnet roller, for bearing and conveying a two-component developer composed of a toner and a carrier, the sleeve being rotatably disposed facing a photoreceptor where an electrostatic latent image is formed, the magnet roller being fixedly disposed inside the sleeve to form a plurality of magnetic poles; and a layer-thickness regulating member disposed facing the developing roller, for regulating a layer-thickness of the two-component developer conveyed by the developing roller, wherein the magnet roller has a main pole for forming a magnetic pole in a developing region for feeding the toner to the photoreceptor, a regulating pole arranged upstream of the magnetic pole formed by the main pole in a rotation direction of the sleeve and so positioned as to be closest to the layer-thickness regulating member, and a pumping pole disposed for pumping the two-component developer upwardly in a vertical direction, wherein an angle $\alpha$ is in a range of no less than 45 degrees nor more than 57 degrees, which is formed between a plane comprising a central line of a magnetic pole formed by the regulating pole and a rotating central axis of the sleeve and a plane comprising a central line of a magnetic pole formed by the pumping pole and the rotating central axis of the sleeve, and wherein an absolute value of a maximum value of strength of a magnetic pole formed by the main pole is in a range of no less than 120 mT nor more than 140 mT.

2. The developing device of claim 1, wherein a number of magnetic poles which belong to the magnet roller is five.

3. The developing device of claim 2, wherein an absolute value of a difference between the maximum value of strength of a magnetic pole formed by the regulating pole and the maximum value of strength of a magnetic pole formed by the pumping pole is in a range of no less than 22.5 mT nor more than 35.0 mT.

4. The developing device of claim 2, wherein the angle $\alpha$ is in a range of no less than 47 degrees nor more than 57 degrees.

5. The developing device of claim 1, wherein a number of magnetic poles which belong to the magnet roller is seven.

6. The developing device of claim 5, wherein an absolute value of a difference between the maximum value of strength of a magnetic pole formed by the regulating pole and the maximum value of strength of a magnetic pole formed by the pumping pole is in a range of no less than 7.0 mT nor more than 9.0 mT.

7. The developing device of claim 5, wherein the angle $\alpha$ is in a range of no less than 45 degrees nor more than 51 degrees.

8. The developing device of claim 1, wherein an angle $\theta$ is greater than 0 degree and 5 degrees or less which is formed between a plane comprising a central line of the magnetic pole formed by the main pole and the rotating central axis of the sleeve and a plane comprising the rotating central axis of the sleeve and a rotating central axis of the photoreceptor, and a position where strength of the magnetic pole is maximized is arranged upstream of the developing region.

9. An image forming apparatus having the developing device of claim 1.

* * * * *